US011313523B2

(12) United States Patent
Hsu

(10) Patent No.: US 11,313,523 B2
(45) Date of Patent: Apr. 26, 2022

(54) LIGHT-EMITTING DIODE NET LIGHT

(71) Applicant: Wei-Lin Hsu, Hsinchu (TW)

(72) Inventor: Wei-Lin Hsu, Hsinchu (TW)

( * ) Notice: Subject to any disclaimer, the term of this patent is extended or adjusted under 35 U.S.C. 154(b) by 175 days.

(21) Appl. No.: 16/746,457

(22) Filed: Jan. 17, 2020

(65) Prior Publication Data

US 2020/0232614 A1 Jul. 23, 2020

(30) Foreign Application Priority Data

Jan. 21, 2019 (CN) ..... 201910052607.7

(51) Int. Cl.

| | |
|---|---|
| ***F21S 4/15*** | (2016.01) |
| ***F21S 9/02*** | (2006.01) |
| ***H01R 12/59*** | (2011.01) |
| ***F21V 21/008*** | (2006.01) |
| *F21Y 115/10* | (2016.01) |

(52) U.S. Cl.

CPC . *F21S 4/15* (2016.01); *F21S 9/02* (2013.01); *F21V 21/008* (2013.01); *H01R 12/598* (2013.01); *F21Y 2115/10* (2016.08)

(58) Field of Classification Search

CPC .. F21S 4/15; F21S 9/02; F21V 23/001; F21V 23/06; H01R 12/598

See application file for complete search history.

(56) References Cited

U.S. PATENT DOCUMENTS

| | | | | |
|---|---|---|---|---|
| 5,893,634 A * | 4/1999 | Wang | F21S 4/15 | 362/249.01 |
| 6,135,616 A * | 10/2000 | Rahman | F21V 23/0407 | 362/249.12 |
| 2014/0132154 A1* | 5/2014 | Fried | F21S 4/15 | 315/76 |
| 2019/0113188 A1* | 4/2019 | Miller | F21V 21/08 | |

FOREIGN PATENT DOCUMENTS

| | | |
|---|---|---|
| CN | 2372550 Y | 4/2000 |
| CN | 2449054 Y | 9/2001 |

* cited by examiner

*Primary Examiner* — Anabel Ton

(74) *Attorney, Agent, or Firm* — Muncy, Geissler, Olds & Lowe, P.C.

(57) ABSTRACT

A light-emitting diode (LED) net light includes a plurality of electrical lines and a plurality of LEDs. Each of the plurality of LEDs is connected across two adjacent electrical lines without breaking the plurality of electrical lines. The plurality of LEDs connected to the same electrical line are mutually spaced, and the plurality of LEDs in the same row are respectively connected to two different electrical lines and are mutually spaced. In the LED net light, the plurality of LEDs are directly connected by plurality of the electrical lines, such that the plurality of LEDs serve as nodes to enable the plurality of electrical lines to stretch into a net structure. Accordingly, the invention does not use those supporting lines, but forms a net structure by having each of the plurality of LEDs be connected across two adjacent electrical lines.

9 Claims, 6 Drawing Sheets

LIGHT-EMITTING DIODE NET LIGHT

FIELD OF THE INVENTION

The present invention relates to a net light, and particularly to a light-emitting diode (LED) net light.

BACKGROUND OF THE INVENTION

Each time as holidays approach, lights are often put up to emphasize the celebration atmosphere. Taking Christmas for instance, Christmas trees or wall facades embellished with net light decorations are seen everywhere in the building or on the street. FIG. 1 shows a conventional net light decoration. In addition to a plurality of conductive lines 210 and a plurality of light-emitting elements 220, a conventional net light decoration 200 further includes at least one supporting line 230 connecting the plurality of light-emitting elements 220. These supporting lines 230 are non-conductive lines and are used merely for connecting every two adjacent light-emitting elements 220 so as to support the plurality of the light-emitting elements 220 to form a net structure.

For example, the CN 2372550 Y and CN 2449054 Y patents disclose some conventional net light decorations. CN 2372550 Y discloses a novel decorative net light, which includes two main lines connected in parallel to a light string in the net light and a connecting line not connected to the main lines and the light string. That is to say, the connecting line only passes through a plurality of nodes formed by the light string, and form a net structure with the plurality of nodes. On the other hand, CN 2449054 Y discloses a novel collapsible structure of a Christmas net light tree frame. The novel collapsible structure of a Christmas net light tree frame includes a plurality of wires, a plurality of net-like Christmas light strings respectively disposed at two of the plurality of wires, and a plurality of ropes, wherein the plurality of ropes are not conducted with the net-like Christmas light strings but merely provide support to the plurality of net-like Christmas light strings. That is to say, supporting lines such as the connecting lines and the plurality of ropes are merely provided for supporting the light strings but are not conducted with the light strings. During a manufacturing process, the light strings need to be connected to the plurality of conductive lines as well as with the supporting lines in order to have the light strings form a net structure. Thus, manufacturing costs and manufacturing processes of such conventional net light decoration are not reduced as a result of the supporting lines provided.

SUMMARY OF THE INVENTION

The primary object of the present invention is to solve the issues caused by the use of supporting lines in a conventional net light, wherein the supporting lines are provided for supporting a plurality of light-emitting diodes (LEDs) to form a net structure.

To achieve the above object, the present invention provides a light-emitting diode (LED) net light including a plurality of electrical lines, a plurality of LEDs, and a plurality of light transmissive packages. Each of the plurality of LEDs is connected across two adjacent electrical lines without breaking the electrical lines. The plurality of LEDs connected on the same electrical line are mutually spaced, the plurality of LEDs in the same row are respectively connected to two different electrical lines and are mutually spaced, and the plurality of LEDs located in two adjacent rows are interlacedly arranged. Thus, the plurality of LEDs serve as nodes to enable the plurality of electrical lines to stretch into a net structure. The plurality of LEDs are surface-mount LEDs, each of the plurality of LEDs comprises two electrodes with different polarities, and the two electrodes of one of the plurality of LEDs are respectively connected to the two adjacent electrical lines which the LED connected thereto. The plurality of light transmissive packages respectively encapsulate the plurality of LEDs and the portion of the plurality of electrical lines connected to the plurality of LEDs.

In one embodiment, the LED net light is connected to a power supply unit. The power supply unit comprises a positive connecting terminal and a negative connecting terminal. The positive connecting terminal is connected to one of plurality of the electrical lines, and the negative connecting terminal is connected to another one of the plurality of electrical lines adjacent to the electrical line, so as to form a parallel circuit. Each of the plurality of LEDs comprises a positive electrode and a negative electrode, wherein the positive electrode is connected to one of the plurality of electrical lines connected to the positive connecting terminal, and the negative electrode is connected to one of the plurality of electrical lines connected to the negative connecting terminal.

In one embodiment, the LED net light includes a positive bridge line enabling the positive connecting terminal to be connected to the plurality of electrical lines, and a negative bridge line enables the negative connecting terminal to be connected to the plurality of electrical lines.

In one embodiment, the LED net light is connected to a power supply unit. The power supply unit comprises a positive connecting terminal and a negative connecting terminal, wherein the positive connecting terminal is connected to one of the plurality of electrical lines, and the negative connecting terminal is connected to one of the plurality of electrical lines. The plurality of LEDs are connected across two of the plurality of electrical lines and form a parallel circuit.

In one embodiment, the LED net light includes a power supply unit. The power supply unit comprises a positive connecting terminal and a negative connecting terminal. The plurality of electrical lines and the plurality of LEDs form a plurality of serial circuits groups. Each of the plurality of serial circuits groups is connected to the positive connecting terminal by one of the electrical lines belonged thereto, and two adjacent serial circuit groups are connected to the negative connecting terminal by the same electrical line.

In one embodiment, an exterior of each of the plurality of electrical lines at a part that is not connected to the plurality of LEDs is provided with an insulation layer.

In one embodiment, the plurality of electrical lines are selected from the group consisting of copper wires, enameled wires, stranded wires, polyvinyl chloride (PVC) wires and copper-clad copper wires.

According to the above disclosure of the invention, the present invention provides the following features compared to the prior art. In the LED net light of the present invention, a net light is formed without using a plurality of supporting lines, wherein the plurality of supporting lines are not conducted with the plurality of LEDs but merely support the plurality of LEDs. Further, in the present invention, the plurality of LEDs are respectively connected to the plurality of electrical lines without breaking the plurality of electrical lines, such that the plurality of LEDs respectively connect to the plurality of electrical lines and the plurality of LEDs serves as nodes to further form the net structure.

DETAILED DESCRIPTION OF THE PREFERRED EMBODIMENTS

Figure 1:
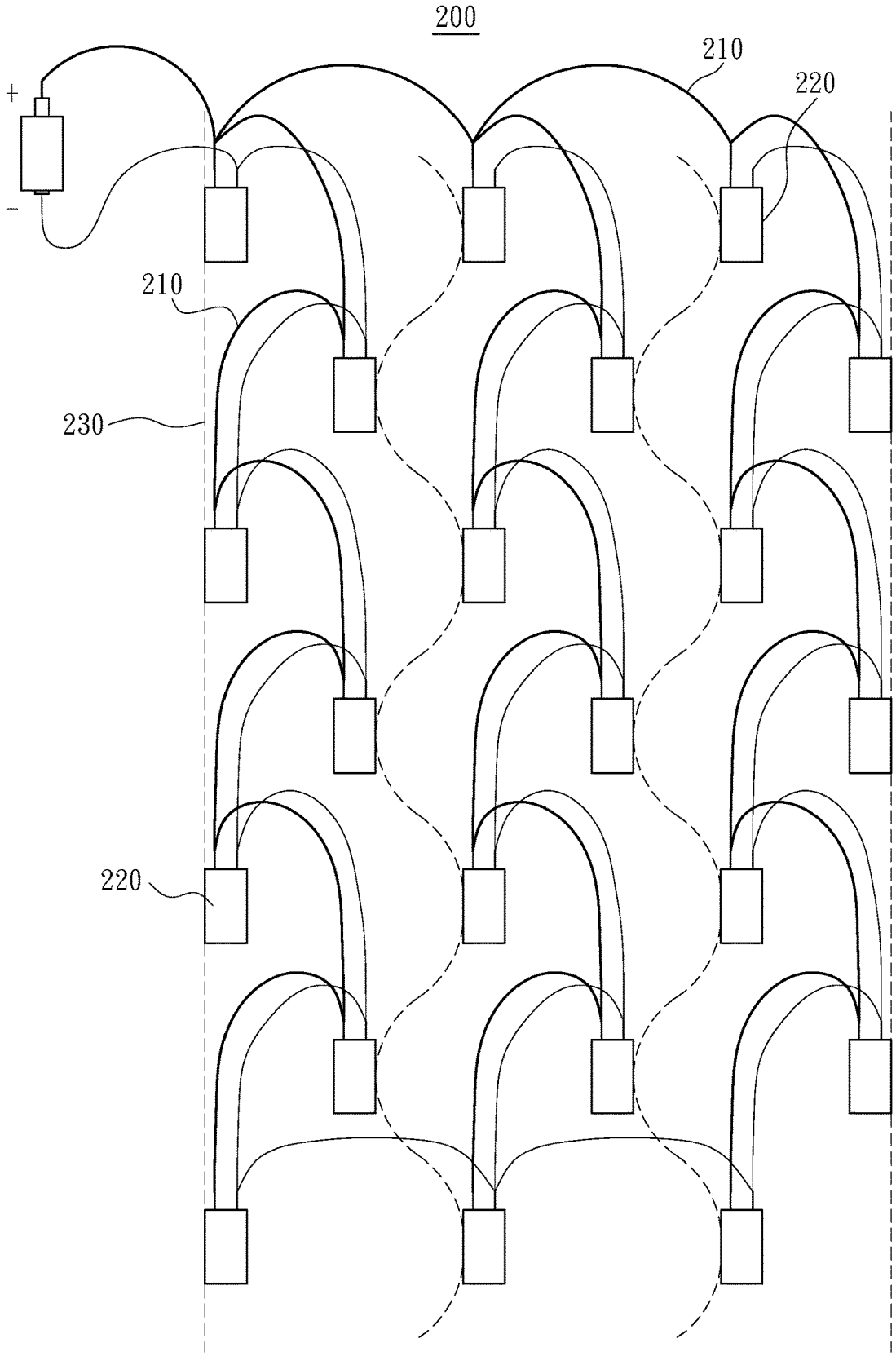
Fig. 1 PRIOR ART
FIG. 1 is a schematic diagram of a conventional net light decoration.

Details and technical content of the present invention are given with the accompanying drawings below.

Referring to FIG. 2, FIG. 3, FIG. 4, FIG. 5 and FIG. 6, the present invention provides a light-emitting diode (LED) net light 100 including a plurality of electrical lines 10, a plurality of LEDs 20, and a plurality of light transmissive packages 60. Specifically, each of the plurality of electrical lines 10 is a continuous and non-broken conductive line. More specifically, the plurality of electrical lines 10 are selected from the group consisting of copper wires, enameled wires, stranded wires, polyvinyl chloride (PVC) wires and copper-clad copper wires, and the plurality of electrical lines 10 are flexible. Moreover, the plurality of LEDs 20 are selected from plug-in LEDs or surface-mount LEDs, and each of the plurality of LEDs 20 is connected across two adjacent electrical lines 10 without breaking the electrical lines 10. That is to say, each of the plurality of electrical lines 10 connecting two adjacent LEDs 20 is the same continuous line segment. Further, the plurality of LEDs 20 connected on the same electrical line 10 are mutually spaced; the LEDs 20 located in the same row are respectively connected to different electrical lines 10 and are mutually spaced. Further, the LEDs 20 located at two adjacent rows are interlacedly arranged. In the LED net light 100, the plurality of LEDs 20 connect to the plurality of electrical lines 10 and serve as nodes so as to enable the plurality of electrical lines 10 to stretch into a net structure. In addition, each of the plurality of LEDs 20 comprises two electrodes with different polarities, and the two electrodes of one of the plurality of LEDs are respectively connected to the two adjacent electrical lines 10 which the LED 20 connected thereto. Besides, the plurality of light transmissive packages 60 respectively encapsulate the plurality of LEDs 20 and the portion of the plurality of electrical lines 10 connected to the plurality of LEDs 20. In one embodiment, an exterior of each of the plurality of electrical lines 10 at a part that is not connected to the plurality of LEDs 20 is provided with an insulation layer 15.

In a conventional net light structure, each of a plurality of LEDs is not only connected to a conductive line, but also connected to a supporting line. The supporting line only provides a function of structural support instead of electrical conduction. Thus, the conventional net light structure enables the plurality of LEDs to form a net structure with the plurality of supporting lines provided. Compared to the conventional structure, the plurality of electrical lines 10 of the invention provide a function of electrical conduction, and are further assembled with the plurality of LEDs 20 to serve as nodes, allowing the plurality of electrical lines 10 to stretch and form a net structure. In brief, the LED net light 100 of the invention is formed by assembling the plurality of LEDs 20 and the plurality of electrical lines 10 without utilizing the supporting lines.

Figure 4:
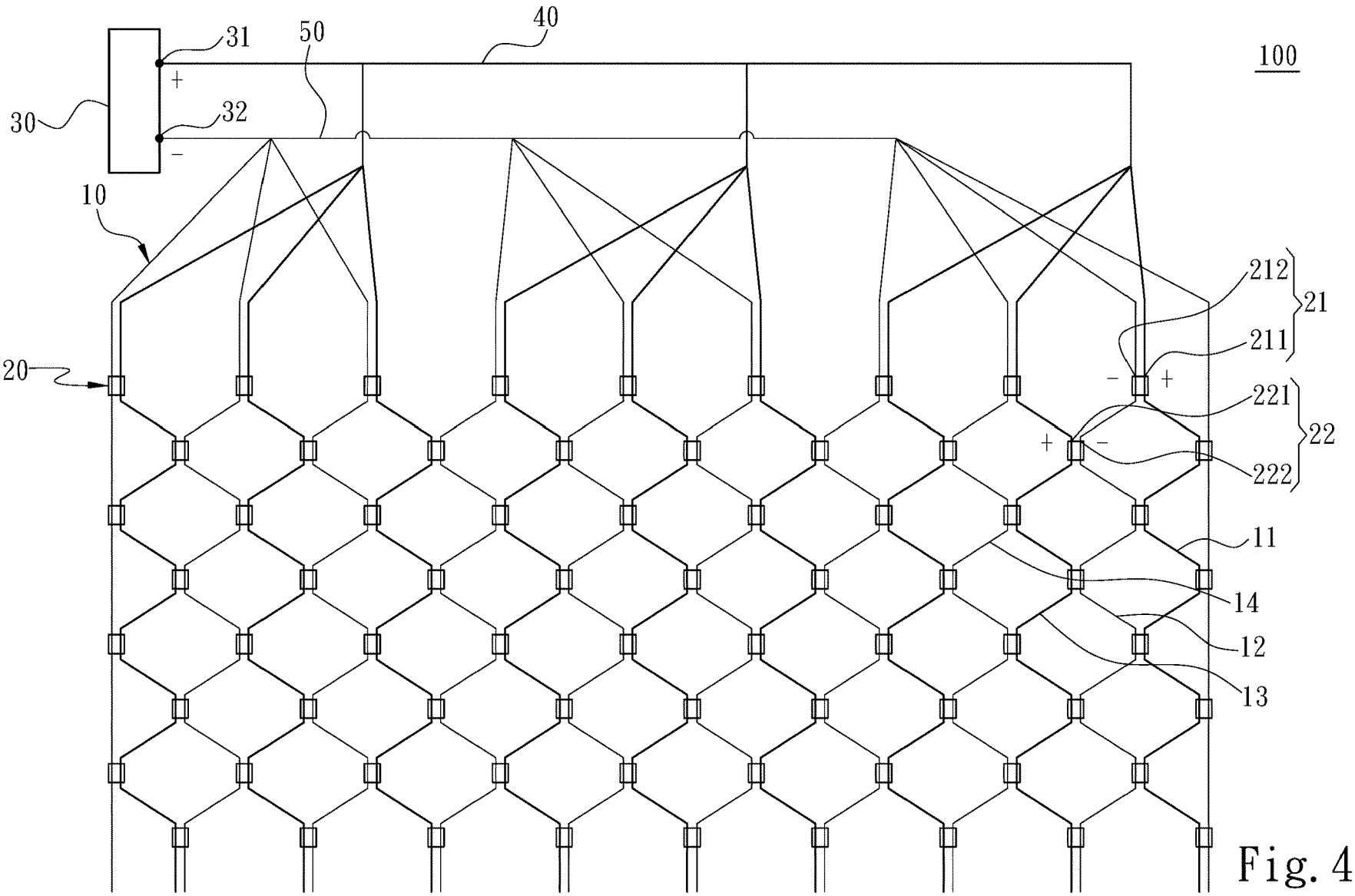
FIG. 4 is a second simplified diagram according to an embodiment of the present invention.
Figure 5:
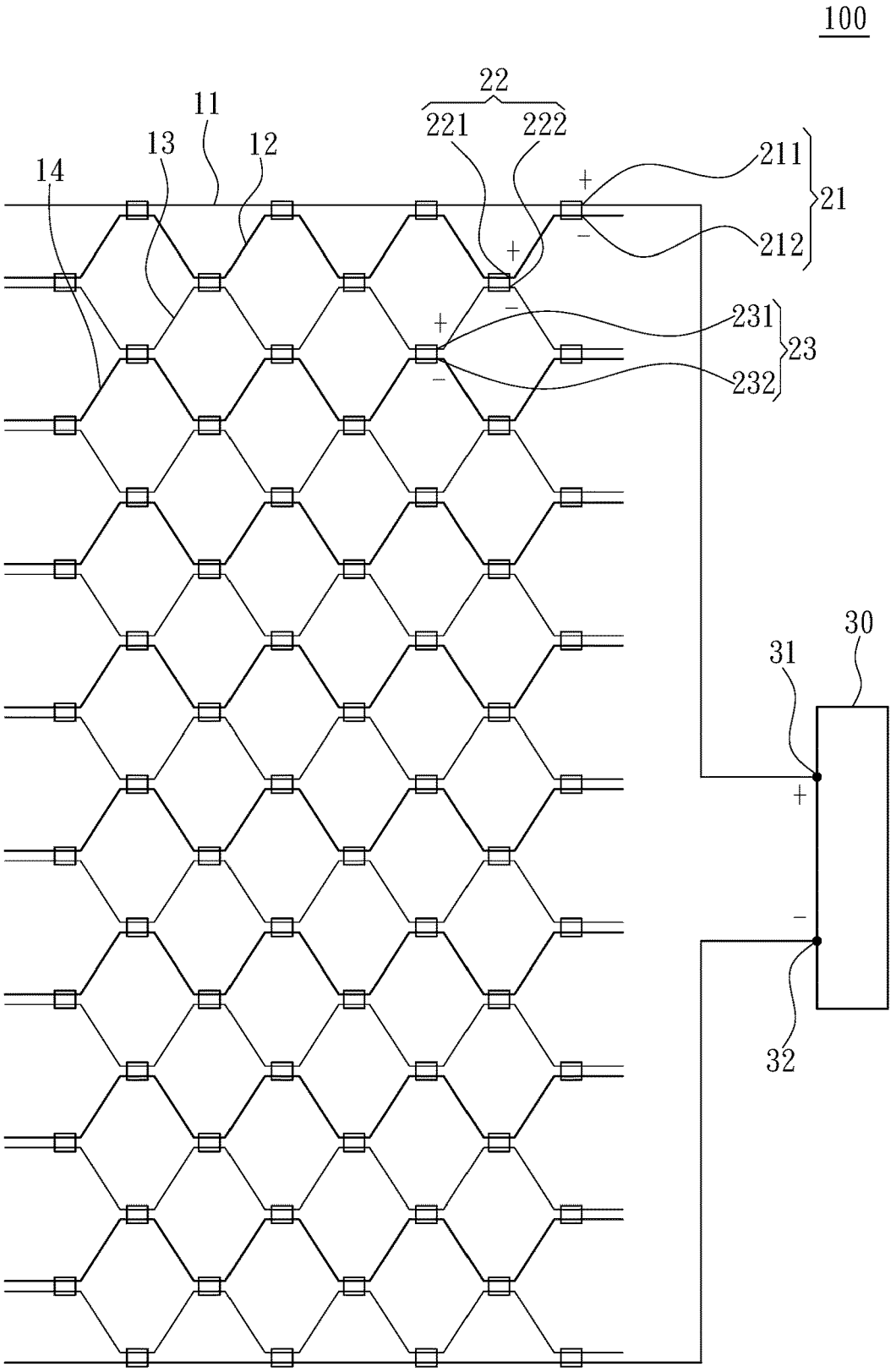
FIG. 5 is a third simplified diagram according to an embodiment of the present invention.

In one embodiment, referring to FIG. 2, FIG. 4, FIG. 5 and FIG. 6, the LED net light 100 includes a power supply unit 30, wherein the power supply unit 30 is selected from a battery or a power supply. Further, the power supply unit 30 includes a circuit control module to determine a light emitting mode of the plurality of LEDs 20. The power supply unit 30 comprises a positive connecting terminal 31 and a negative connecting terminal 32. The plurality of LEDs 20 are implemented in form of a parallel circuit, a serial circuit or a parallel-serial circuit according to a connection configuration of the power supply unit 30. The parallel circuit is first described. For better illustration, the plurality of electrical lines 10 comprises a first electrical line 11, a second electrical line 12, a third electrical line 13 and a fourth electrical line 14. The plurality of LEDs 20 comprises a first LED 21 and a second LED 22. The positions of the first LED 21 and the second LED 22 are as shown in FIG. 4. Further, the first LED 21 comprises a first positive electrode 211 and a first negative electrode 212, and the second LED 22 comprises a second positive electrode 221 and a second negative electrode 222.

Figure 2:
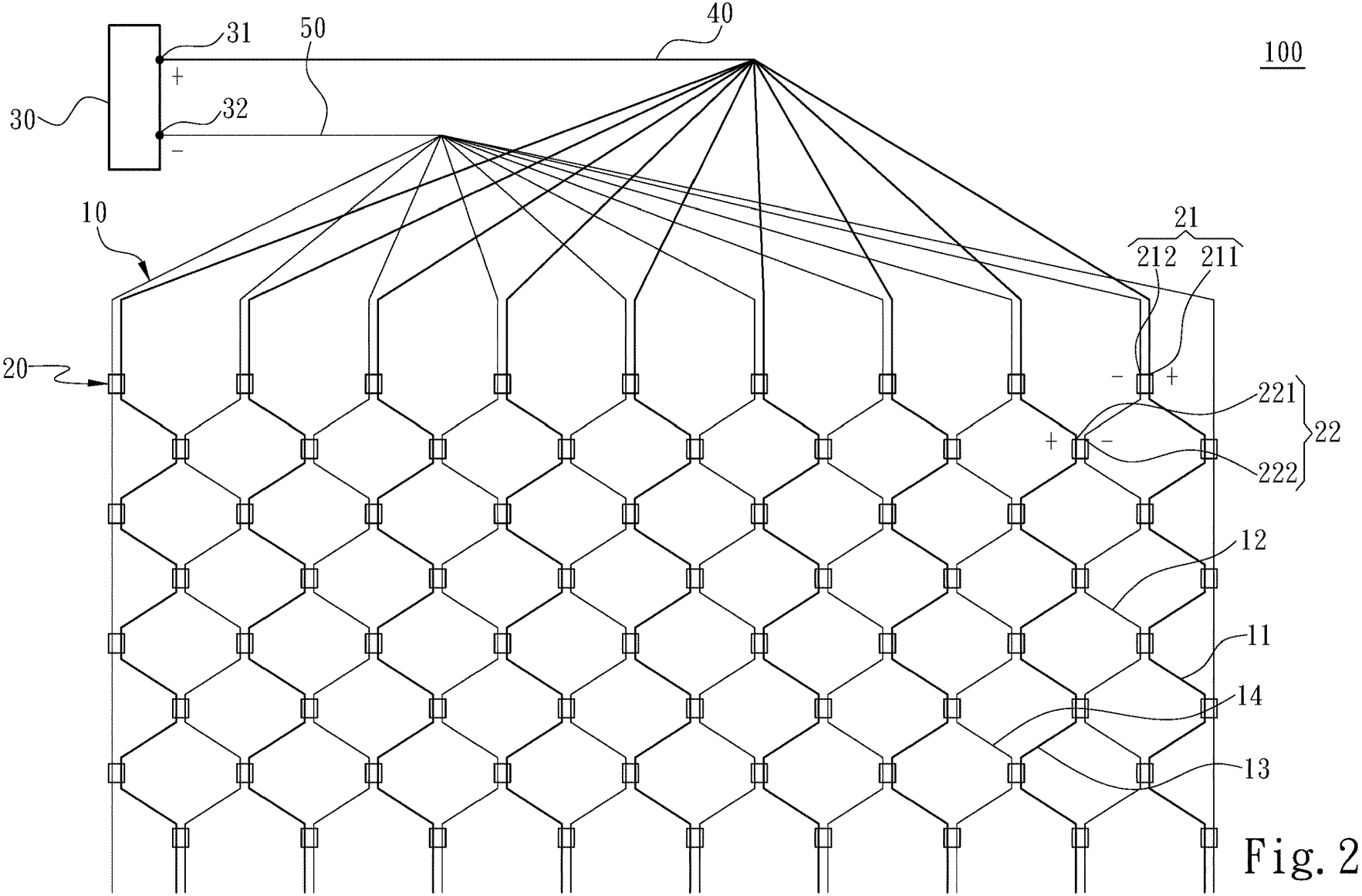
FIG. 2 is a first simplified diagram according to an embodiment of the present invention.
Figure 3:
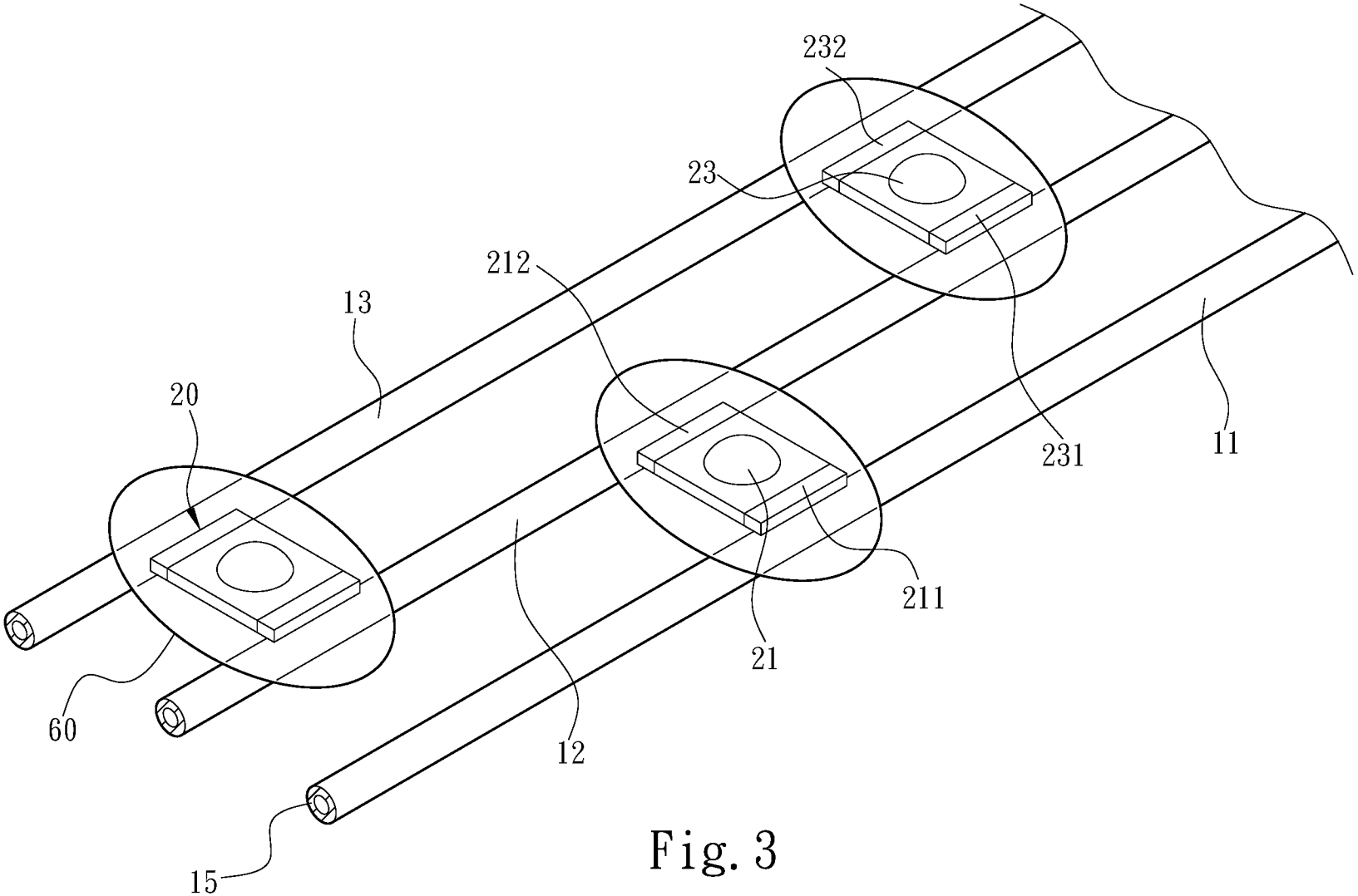
FIG. 3 is a schematic diagram of an assembly of light-emitting diodes (LEDs) in FIG. 2.

Referring to FIG. 2 and FIG. 4, the positive connecting terminal 31 is separately connected to the first electrical line 11 and the third electrical line 13, and the negative connecting terminal 32 is separately connected to the second electrical line 12 and the fourth electrical line 14. Further, the first positive electrode 211 of the first LED 21 is connected to the first electrical line 11, and the first negative electrode 212 of the first LED 21 is connected to the second electrical line 12; the second positive electrode 221 of the second LED 22 is connected to the third electrical line 13, and the second negative electrode 222 of the second LED 22 is connected to the second electrical line 12. The remaining LEDs 20 that are not described are in parallel circuits based on the foregoing configuration. Further, in one embodiment, the LED net light 100 further includes a positive bridge line 40 and a negative bridge line 50. The positive bridge line 40 is connected to the positive connecting terminal 31, and is separately connected to the first electrical line 11 and the third electrical line 13. The negative bridge line 50 is connected to the negative connecting terminal 32, and is separately connected to the second electrical line 12 and the fourth electrical line 14.

Further, the serial circuit is explained herein. For specific description, apart from the first LED 21 and the second LED 22, the plurality of LEDs 20 further comprises a third LED 23. The third LED 23 includes a third positive electrode 231 and a third negative electrode 232. Accordingly, in one embodiment, the first electrical line 11 is connected to the positive connecting terminal 31 and serves as a power input terminal. The first positive electrode 211 of the first LED 21 is connected to the first electrical line 11, and the first negative electrode 212 of the first LED 21 is connected to the second electrical line 12; the second positive electrode 221 of the second LED 22 is connected to the second electrical line 12, and the second negative electrode 222 of the second LED 22 is connected to the third electrical line 13; the third positive electrode 231 of the third LED 23 is connected to the third electrical line 13, and the third negative electrode 232 is connected to the fourth electrical line 14. The remaining LEDs 20 that are not described are in serial circuits according to the above configuration.

Figure 6:
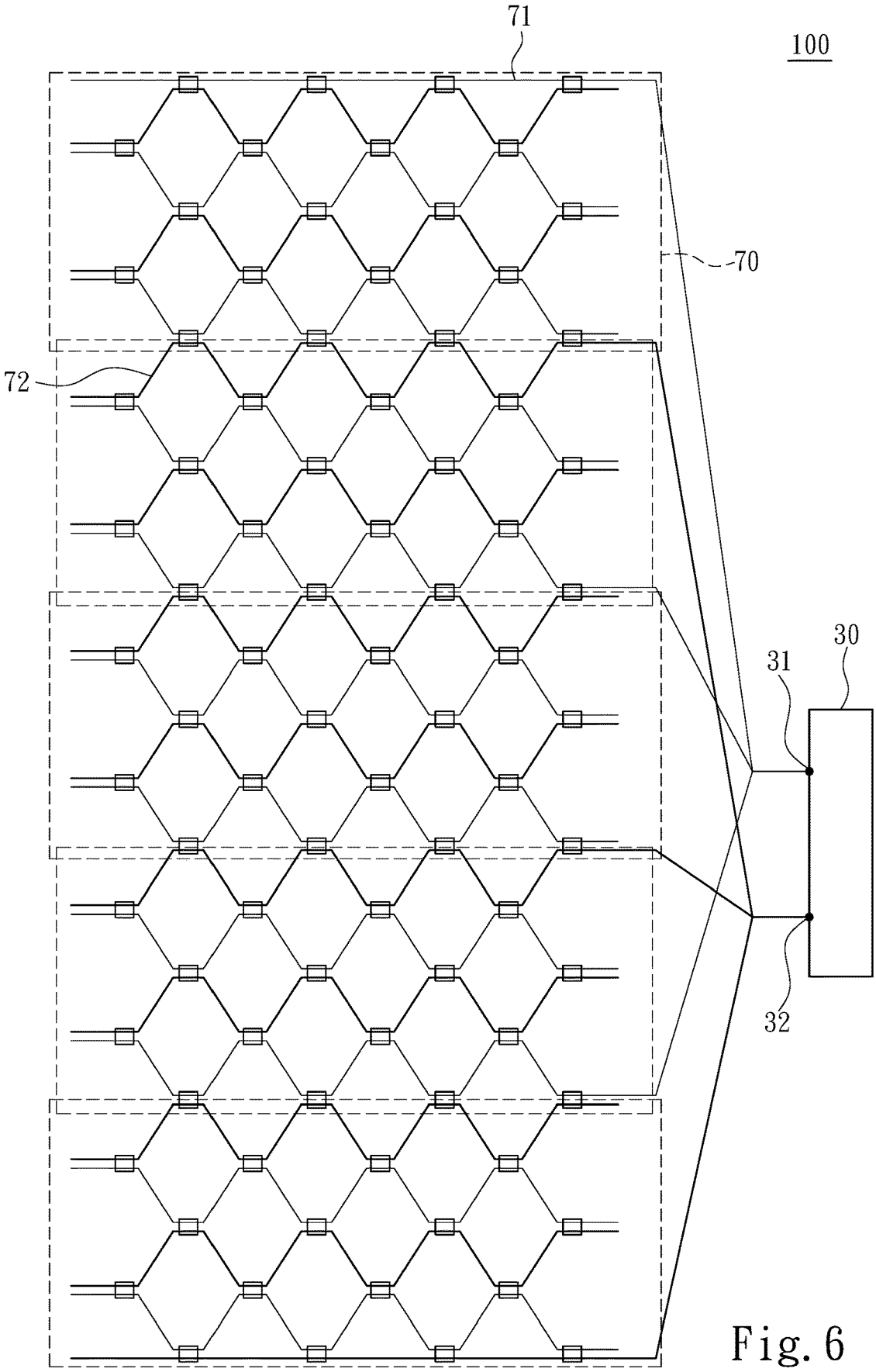
FIG. 6 is a fourth simplified diagram according to an embodiment of the present invention.

As shown in FIG. 6, in one embodiment, the plurality of LEDs 20 further form a circuit in a hybrid form of serial and parallel connections. In the LED net light 100, the plurality of electrical lines 10 and the plurality of LEDs 20 first form a plurality of serial circuit groups 70, each of the plurality of serial circuit groups 70 is connected to the positive connecting terminal 31 by one of the plurality of electrical lines 71 belonged thereto, and two adjacent serial circuit groups 70 are connected to the negative connecting terminal 32 by a same electrical line 72.

What is claimed is:

1. A light-emitting diode (LED) net light, comprising:

a plurality of electrical lines;

a plurality of LEDs, each of the plurality of LEDs connected across two adjacent electrical lines without breaking the plurality of electrical lines, the LEDs connected on the same electrical line being mutually spaced, the LEDs in a same row respectively connected to two different electrical lines and mutually spaced, the LEDs of two adjacent rows being interlacedly arranged, the plurality of LEDs serving as nodes to enable the plurality of electrical lines to stretch into a net structure, wherein the plurality of LEDs are surface-mount LEDs, each of the plurality of LEDs comprises two electrodes with different polarities, and the two electrodes of one of the plurality of LEDs are respectively connected to the two adjacent electrical lines which are adjacent to the LED connected thereto;

a plurality of light transmissive packages, respectively encapsulating the plurality of LEDs and the portion of the plurality of electrical lines connected to the plurality of LEDs;

a power supply unit, the power supply unit comprises a positive connecting terminal and a negative connecting terminal, the positive connecting terminal is connected to a electrical line of the plurality of electrical lines, and the negative connecting terminal is connected a electrical line of the plurality of electrical lines which is adjacent to the electrical line, so as to form a parallel circuit, each of the plurality of LEDs comprises a positive electrode and a negative electrode, the positive electrode is connected to one of the plurality of electrical lines connected to the positive connecting terminal, and the negative electrode is connected to one of the plurality of electrical lines connected to the negative connecting terminal;

a positive bridge line enabling the positive connecting terminal to be connected to the plurality of electrical lines; and a negative bridge line enabling the negative connecting terminal to be connected to the plurality of electrical lines.

2. The LED net light of claim 1, wherein an exterior of each of the plurality of electrical lines at a part not connected to the plurality of LEDs is provided with an insulation layer.

3. The LED net light of claim 1, wherein the plurality of electrical lines are selected from the group consisting of copper wires, enameled wires, stranded wires, polyvinyl chloride (PVC) wires and copper-clad copper wires.

4. A light-emitting diode (LED) net light, comprising:

a plurality of electrical lines;

a plurality of LEDs, each of the plurality of LEDs connected across two adjacent electrical lines without breaking the plurality of electrical lines, the LEDs connected on the same electrical line being mutually spaced, the LEDs in a same row respectively connected to two different electrical lines and mutually spaced, the LEDs of two adjacent rows being interlacedly arranged, the plurality of LEDs serving as nodes to enable the plurality of electrical lines to stretch into a net structure, wherein the plurality of LEDs are surface-mount LEDs, each of the plurality of LEDs comprises a positive electrode and a negative electrode, and the positive electrode and the negative electrode of one of the plurality of LEDs are respectively connected to the two adjacent electrical lines which are adjacent to the LED connected thereto;

a plurality of light transmissive packages, respectively encapsulating the plurality of LEDs and the portion of the plurality of electrical lines connected to the plurality of LEDs; and a power supply unit including a positive connecting terminal and a negative connecting terminal, the plurality of electrical lines and the plurality of LEDs forms a serial circuit group, the positive connecting terminal is connected to one of the plurality of electrical lines, and the negative connecting terminal is connected to one of the plurality of electrical lines;

wherein the plurality of electrical lines of the serial circuit group comprises:

an electrical line connected to the positive connecting terminal, the plurality of LEDs belonged to the electrical line connected to the positive connecting terminal is connected thereto by the positive electrode;

an electrical line connected to the negative connecting terminal, the plurality of LEDs belonged to the electrical line connected to the negative connecting terminal is connected thereto by the negative electrode;

a plurality of electrical lines not connected to the power supply unit, the plurality of LEDs belonged to the plurality of electrical lines not connected to the power supply unit is connected thereto by the positive electrode and the negative electrode interlacedly arranged.

5. The LED net light of claim 4, wherein an exterior of each of the plurality of electrical lines at a part not connected to the plurality of LEDs is provided with an insulation layer.

6. The LED net light of claim 4, wherein the plurality of electrical lines are selected from the group consisting of copper wires, enameled wires, stranded wires, polyvinyl chloride (PVC) wires and copper-clad copper wires.

7. A light-emitting diode (LED) net light, comprising:

a plurality of electrical lines;

a plurality of LEDs, each of the plurality of LEDs connected across two adjacent electrical lines without breaking the plurality of electrical lines, the LEDs connected on the same electrical line being mutually spaced, the LEDs in a same row respectively connected to two different electrical lines and mutually spaced, the LEDs of two adjacent rows being interlacedly arranged, the plurality of LEDs serving as nodes to enable the plurality of electrical lines to stretch into a net structure, wherein the plurality of LEDs are surface-mount LEDs, each of the plurality of LEDs comprises two electrodes with different polarities, and the two electrodes of one of the plurality of LEDs are respectively connected to the two adjacent electrical lines which are adjacent to the LED connected thereto;

a plurality of light transmissive packages, respectively encapsulating the plurality of LEDs and the portion of the plurality of electrical lines connected to the plurality of LEDs; and a power supply unit including a positive connecting terminal and a negative connecting terminal, the plurality of electrical lines and the plurality of LEDs forms a plurality of serial circuit groups, each of the plurality of serial circuit groups connected to the positive connecting terminal by one of the plurality of electrical lines belonged thereto, and two adjacent serial circuit groups connected to the negative connecting terminal by a same electrical line.

8. The LED net light of claim 7, wherein an exterior of each of the plurality of electrical lines at a part not connected to the plurality of LEDs is provided with an insulation layer.

9. The LED net light of claim 7, wherein the plurality of electrical lines are selected from the group consisting of copper wires, enameled wires, stranded wires, polyvinyl chloride (PVC) wires and copper-clad copper wires.

* * * * *